US006807945B2

(12) United States Patent
Reiter et al.

(10) Patent No.: US 6,807,945 B2
(45) Date of Patent: Oct. 26, 2004

(54) COMPENSATION ELEMENT FOR A FUEL INJECTION VALVE

(75) Inventors: Ferdinand Reiter, Markgroeningen (DE); Martin Maier, Möglingen (DE)

(73) Assignee: Robert Bosch GmbH, Stuttgart (DE)

( * ) Notice: Subject to any disclaimer, the term of this patent is extended or adjusted under 35 U.S.C. 154(b) by 2 days.

(21) Appl. No.: 10/258,322

(22) PCT Filed: Feb. 22, 2002

(86) PCT No.: PCT/DE02/00660

§ 371 (c)(1),
(2), (4) Date: Jan. 29, 2003

(87) PCT Pub. No.: WO02/066822

PCT Pub. Date: Aug. 29, 2002

(65) Prior Publication Data

US 2003/0145832 A1 Aug. 7, 2003

(30) Foreign Application Priority Data

Feb. 22, 2001 (DE) ..... 101 08 466

(51) Int. Cl.[7] ..... F02M 55/02
(52) U.S. Cl. ..... 123/470; 239/533.11
(58) Field of Search ..... 123/470, 468, 123/469, 456, 467, 472, 198 D; 239/533.11, 600

(56) References Cited

U.S. PATENT DOCUMENTS

| | | | | |
|---|---|---|---|---|
| 5,247,918 A | * | 9/1993 | Wakeman | 123/470 |
| 6,263,863 B1 | * | 7/2001 | Giovannini et al. | 123/470 |
| 6,640,784 B1 | * | 11/2003 | Sims, Jr. | 123/470 |
| 6,684,861 B2 | * | 2/2004 | Reiter | 123/470 |

FOREIGN PATENT DOCUMENTS

| | | |
|---|---|---|
| DE | 42 40 514 | 6/1994 |
| DE | 197 35 665 | 1/1999 |
| DE | 100 38 763 | 2/2002 |
| EP | 0 716 226 | 6/1996 |
| EP | 0 969 203 | 1/2000 |
| JP | 06 010 794 | 1/1994 |
| JP | 10 252 609 | 9/1998 |

* cited by examiner

*Primary Examiner*—Mahmoud Gimie
(74) *Attorney, Agent, or Firm*—Kenyon & Kenyon

(57) ABSTRACT

A compensating element for mounting and supporting a fuel injector in a cylinder head of an internal combustion engine is designed in the form of a washer and positioned between a valve housing of the fuel injector and a wall of a receiving bore of the cylinder head. The washer has a round or oval cross-section and sets apart a shoulder of the valve housing from a shoulder of the cylinder head.

9 Claims, 2 Drawing Sheets

COMPENSATION ELEMENT FOR A FUEL INJECTION VALVE

FIELD OF THE INVENTION

The present invention relates to a compensating element for a fuel injector.

BACKGROUND INFORMATION

A fuel injection system having a compensating element is known from German Published Patent Application No. 197 35 665, the compensating element including a supporting body, which has a dome-shaped supporting surface. A fuel injector is supported by this compensating element in a receiving bore of a cylinder head. Since the fuel injector rests on the spherically shaped surface by the supporting surface, the fuel injector is able to be mounted at an angle that deviates from the axis of the receiving bore by up to a certain amount, and can be pressed firmly into the receiving bore by appropriate means, e.g., a clamping shoe. This allows a simple adaptation to the fuel supply lines. Tolerances arising in the manufacture and in the mounting of the fuel injectors can be compensated for.

It is disadvantageous, however, that the supporting body requires expensive manufacturing and that a precisely manufactured, spherical surface is needed. The rigid supporting body cannot be compressed, and thus no compensation in the axial direction of the receiving bore occurs. Moreover, tolerance can only be compensated with respect to the specified geometry of the spherical surface. A radial compensation movement purely with respect to the receiving bore is not possible.

SUMMARY OF THE INVENTION

In contrast, the compensating element for a fuel injector according to the present invention has the advantage that the fuel injector is supported by a washer having an oval or round cross-section, which is inserted between the fuel injector and a wall of a receiving bore of the cylinder head accommodating the fuel injector, and which has no sealing function. Due to its elasticity, the compensating element compensates for manufacturing tolerances of the individual components as well as for tolerances that are caused by the warming of the fuel injector during operation, and in this manner prevents twisting and malpositions.

It is especially advantageous that the washer may either be slit and then pressed onto a valve housing of the fuel injector by press-fitting, or be designed in the form of a closed ring which may be loosely slipped onto the valve housing.

Advantageously, the washer may be fabricated out of wire, made of alloyed or non-alloyed steel, for example.

In this context, a manufacture using copper or a copper alloy is particularly advantageous since copper has high thermal conductivity and excellent surface adaptation.

DETAILED DESCRIPTION

Figure 1:
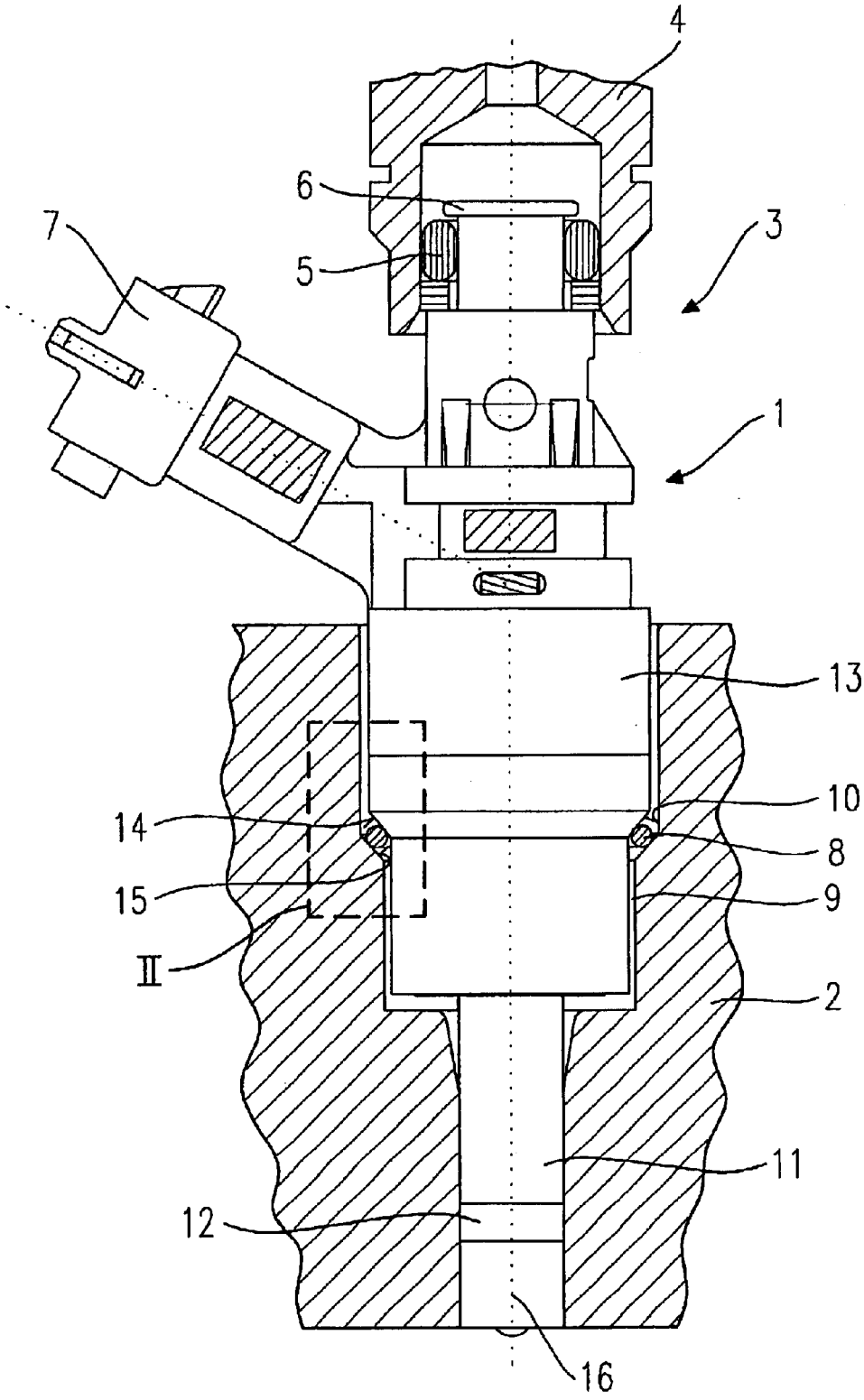
FIG. 1 shows a schematic, part-sectional view of an exemplary embodiment of a compensating element constructed according to the present invention, for a fuel injector in a cylinder head of an internal combustion engine.

FIG. 1 shows a schematic part-sectional view through an exemplary embodiment of a compensating element for a fuel injector in a receiving bore of a cylinder head of a mixture-compressing internal combustion engine having externally supplied ignition, as constructed according to the present invention.

In this case, a fuel injector 1 is designed in the form of a directly injecting fuel injector 1 and installed in a cylinder head 2 of an internal combustion engine. At an end 3 on the inflow side, fuel injector 1 has a plug connection to a fuel distributor line 4, which is sealed by a gasket 5 between fuel distributor line 4 and a supply-line nipple 6 of fuel injector 1. Fuel injector 1 has an electrical connection 7 for the electrical contacting to actuate fuel injector 1.

According to the present invention, in a receiving bore 9 of cylinder head 2, fuel injector 1 is provided with a washer 8, which is used as compensating element for fuel injector 1 in receiving bore 9.

In this context, washer 8 has a plurality of functions. On the one hand, by setting fuel injector 1 apart from a wall 10 of receiving bore 9, fuel injector 1 is able to be centered, which counteracts a twisting of fuel injector 1, for instance, in the area of a nozzle body 11 of fuel injector 1 and, thus, contributes to the sealing effect of a sealing ring 12 slipped onto nozzle body 11, which seals cylinder head 2 against the combustion chamber (not shown further) of the internal combustion engine.

Moreover, without requiring expensive reworking of the components, washer 8 is able to compensate for manufacturing tolerances of the individual components, such as nozzle body 11 or a valve housing 13, which lead to asymmetries in fuel injector 1.

Washer 8 may also compensate for temperature-related tolerances, which may occur as a result of warming of fuel injector 1 and of cylinder head 2 during operation of the internal combustion engine. For instance, tolerances of this kind may lead to stresses and warping of the plug connection between fuel injector 1 and fuel distributor line 4.

Stainless steel, for example, non-alloyed but surface-treated steel for better thermal conductivity, or also copper and copper alloys may come into consideration as materials for manufacturing washer 8, which may, for instance, be drawn as wire and then shaped. Especially the latter materials have excellent thermal conductivity and good surface adaptation because of plastic deformability.

As shown in the exemplary embodiment, washer 8 may also have a round cross-section or an oval shape as well. The fitting with respect to fuel injector 1 may be accomplished either by clearance fit of by press-fit. The clearance fit, which allows washer 8 to assume an optimal position under the prevailing conditions, is particularly suitable for closed washers 8, while the press fit, which is especially easy to implement in the case of slit washers 8, offers an effective protection against the loss of washer 8 when fuel injector 1 is installed or uninstalled.

Figure 2:
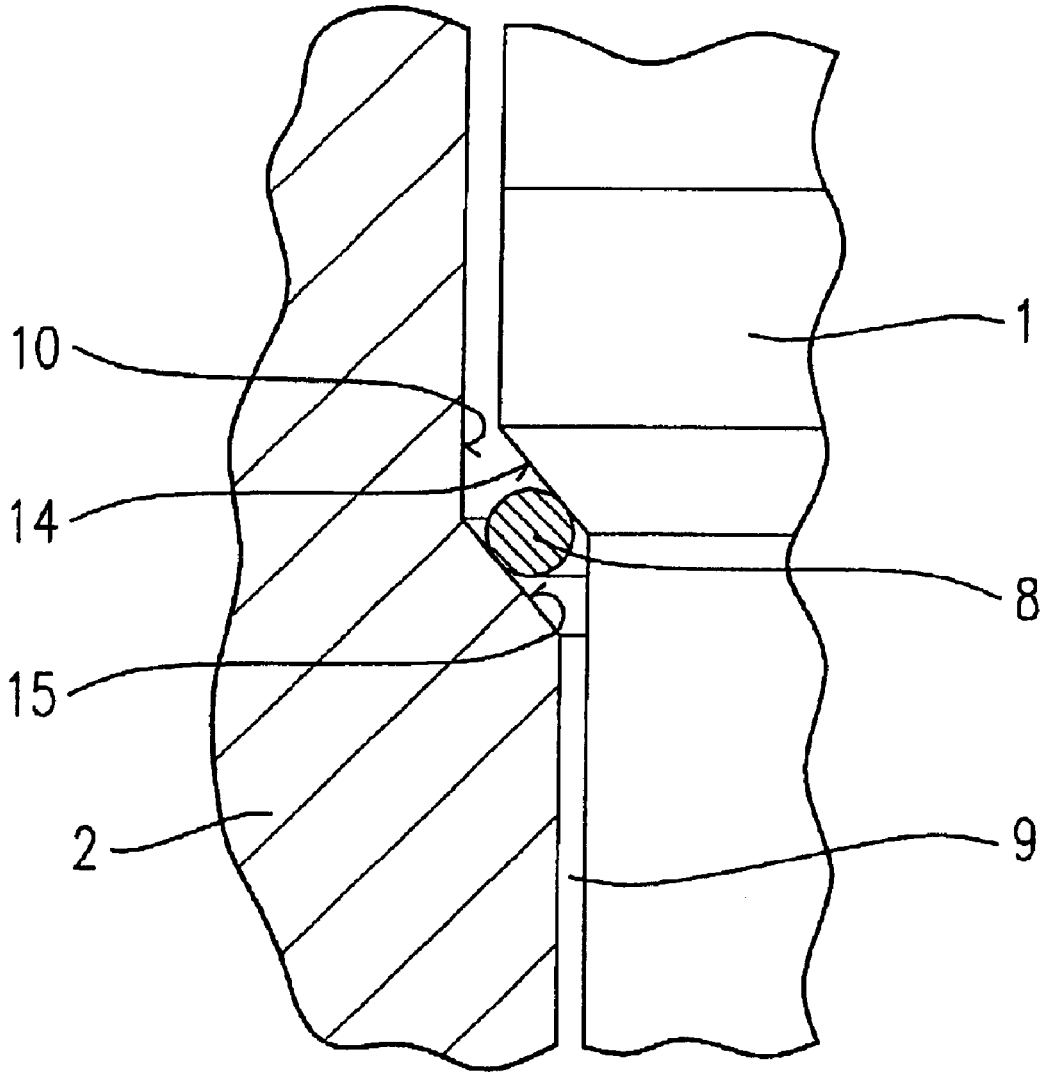
FIG. 2 shows a schematic cut-away portion of the compensating element, in the area II represented in FIG. 1, constructed according to the exemplary embodiment of the present invention.

FIG. 2 shows a schematic cut-away portion, in the area II of FIG. 1, of the compensating element constructed according to the exemplary embodiment of the present invention as represented in FIG. 1.

On the basis of FIG. 2, particular attention should be paid to the fact that the installation of washer 8 requires no modifications in the form of receiving bore 9 of cylinder head 2 or of valve housing 13 of fuel injector 1.

Normally, fuel injector 1 rests in receiving bore 9 on a shoulder 15 of cylinder head 2 by a shoulder 14 of valve housing 13, which is beveled at an angle of approx. 45°, shoulder 15 having an at least similar or, preferably, identical angle of inclination. However, due to manufacturing inaccuracies and warming, the afore-mentioned tolerances arise.

Washer 8 is simply placed on shoulder 15 of cylinder head 2, or slipped onto valve housing 13 in the area of shoulder 14, thereby opening the previously closed shoulder contact between fuel injector 1 and receiving bore 9 to a distance that corresponds to the diameter of washer 8. This allows the washer to assume a position that is optimal under the given conditions, and may also have the result, for example, that the ring may be tilted or warped with respect to a longitudinal axis 16 of fuel injector 1 or receiving bore 9. This permits the desired tolerance compensation, which prevents tensions from building up and malfunctions from occurring later.

The present invention is not limited to the represented exemplary embodiment and is also applicable, for example, to fuel injectors 1 for injection into the combustion chamber of a self-igniting internal combustion engine.

What is claimed is:

1. A compensating element for mounting a fuel injector in a cylinder head of an internal combustion engine, comprising:

a washer positioned between a valve housing of the fuel injector and a wall of a receiving bore of the cylinder head, wherein:

the washer includes a cross-section having one of a round shape and an oval shape, the cross-section being taken along a plane defined by a longitudinal axis of the receiving bore and a radius of the receiving bore, and the washer sets apart a shoulder of the valve housing from a shoulder of the cylinder head.

2. The compensating element as recited in claim 1, wherein:

the washer is fabricated out of a wire.

3. The compensating element as recited in claim 1, wherein:

the washer is closed.

4. The compensating element as recited in claim 3, wherein:

the washer is able to be loosely placed on the valve housing.

5. The compensating element as recited in claim 1, wherein:

the washer is slit.

6. The compensating element as recited in claim 5, wherein:

the washer is pressed onto the valve housing.

7. The compensating element as recited in claim 1, wherein:

the washer is made of stainless steel.

8. The compensating element as recited in claim 1, wherein:

the washer is made of unalloyed, surface-treated steel.

9. The compensating element as recited in claim 1, wherein:

the washer is made of one of copper and a copper alloy.

* * * * *